United States Patent [19]

Moore et al.

[11] Patent Number: 4,487,181

[45] Date of Patent: Dec. 11, 1984

[54] FUEL SUPPLY SYSTEM FOR AN INTERNAL COMBUSTION ENGINE

[75] Inventors: John H. Moore, Kingscote; Andrew P. Ives, Shilton, both of England

[73] Assignee: Lucas Industries public limited company, Birmingham, England

[21] Appl. No.: 475,388

[22] Filed: Mar. 14, 1983

[30] Foreign Application Priority Data

Apr. 3, 1982 [GB] United Kingdom ..... 8209950

[51] Int. Cl.[3] ..... F02D 31/00

[52] U.S. Cl. ..... 123/357; 123/486; 73/119 A

[58] Field of Search ..... 123/357, 358, 359, 486, 123/488; 73/119 A

[56] References Cited

U.S. PATENT DOCUMENTS 4,248,194 2/1981 Drutchas et al. ..... 123/357
4,368,705 1/1983 Stevenson et al. ..... 123/357
4,398,515 8/1983 Canup et al. ..... 123/357

FOREIGN PATENT DOCUMENTS 146023 11/1981 Japan ..... 123/357

*Primary Examiner*—Magdalen Y. C. Moy

[57] ABSTRACT

A fuel supply system for an internal combustion engine includes a mechanically actuated fuel pump which has at least one electromagnetically operable valve for controlling an operating parameter of the pump e.g. fuel delivery. A transducer is provided which provides an indication of the position of a moving part of the pump which determines the fuel delivery. The system also includes an electronic control system which determines the current flow to the valve and hence the position of said part. When the pump is manufactured there is created during its testing test data which is stored in a memory which conveniently is secured to the pump. The test data in the memory is utilized by the control system during normal operation of the fuel supply system.

7 Claims, 1 Drawing Figure

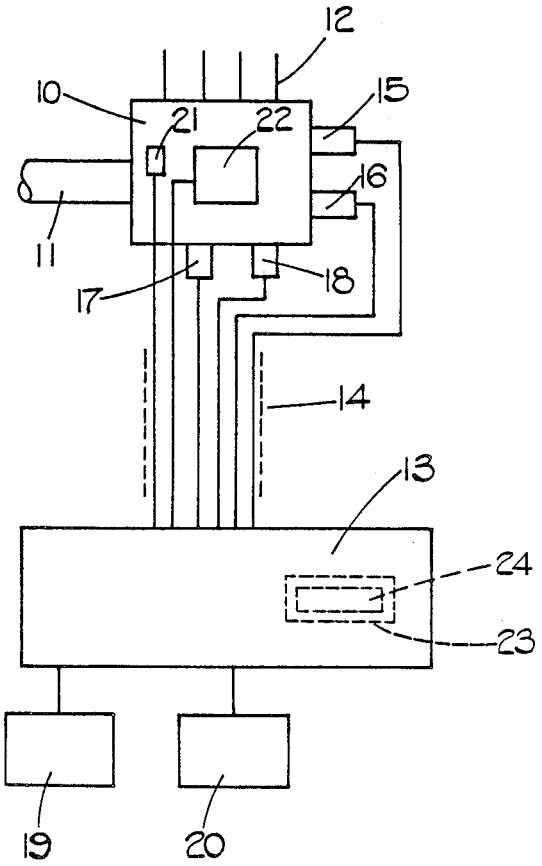
12
10
21
22
15
16
11
17
18
14
13
24
23
19
20

FUEL SUPPLY SYSTEM FOR AN INTERNAL COMBUSTION ENGINE

This invention relates to a fuel supply system for supplying fuel to an internal combustion engine in particular a compression ignition engine and comprising a mechanically actuated high pressure pump, at least one electrically operated control for determining an operating parameter of the pump and an electronic control system for controlling the flow of electric current to said control thereby to influence said operating parameter.

An example of the mechanical pump forming part of the apparatus is described in British Published Specification No. 2037365A. This pump has an axially slidable rotary distributor member determining the amount of fuel delivered at each injection stroke of the apparatus. This is achieved by the provision of inclined stop surfaces on an axially fixed part of the pump and complementary surfaces on shoes which rotate with and move axially with the distributor member. The axial position of the distributor member is determined by the fluid pressure in a chamber which urges the distributor member against the action of a spring.

The control of the fluid pressure in the chamber is determined by fluid potentiometer action in which one of the orifices is formed by an electromagnetically operable valve. A signal indicative of the axial position of the distributor member is provided by a transducer which is incorporated in the pump.

The flow of current to the valve is determined by an electronic control system which receives the signal from the transducer as a feed back signal. The pump in practice will also include an adjustable cam ring which may be operated in a similar manner and which will also include a transducer to provide a feedback signal. The electronic control system will include for a particular engine application, memory devices in which stored information which will for example, in conjunction with the remaining portions of the control system, ensure that no more than a specified amount of fuel can be delivered at each injection stroke to the engine at a given speed of the engine. The control system will seek to establish a particular axial position of the distributor member when a particular demand is made by an operator.

In the above situation the desired amount of fuel will only be delivered if the manufacturing tolerances of the pump including transducers are held to very close limits the also if various adjustments are made accurately when the pump is tested. This also applies to the timing of delivery of the fuel. Only if the pump is constructed within the manufacturing limits and also accurately adjusted, is it possible for any pump to operate in conjunction with any control system. It would be possible for the control system and the pump to be tested together but this would mean that throughout the life of the apparatus the pump and its control system would have to remain together. This would raise problems in service since if the pump proved to be defective and needed to be replaced, the control system would also have to be replaced and vice-versa.

In order to provide interchangeability and also to reduce the manufacturing costs by allowing wider tolerances and reducing the need for accurate adjustment, it is proposed to produce a test record for each pump after manufacture and to make the record available to a control system when the pump and control system are connected together during assembly of for example, the vehicle powered by the engine. In this manner the electronic control system can take into account the information in the test record during its control of the pump so that the desired amount of fuel is supplied to the engine and the timing of delivery is as required.

According to the invention in a fuel supply system of the kind specified the pump has associated therewith a test record which is utilised in use to supply test data to the control system, said control system being arranged to utilise said data in determining said operating parameter of the pump in use.

An example of a fuel supply system in accordance with the invention is shown in the accompanying drawing. Reference numeral 10 denotes a mechanically operated fuel injection pump 10 having a drive shaft 11 coupled in use to a rotary part of an associated engine and having outlets coupled by pipelines 12 to the injection nozzles respectively of the engine. The pump can be of the type described in the aforementioned published specification.

Indicated at 13 is an electronic control system which is coupled to the pump by means of a cable 14. The pump incorporates electromagnetically operable valves 15, 16 to which electric control currents are supplied by conductors in the cable, and also transducers 17, 18 which supply signals to the control system representing the position of various parts of the pump. The control system 13 may incorporate a microprocessor which controls the flow of electric current to the valves 15, 16 in accordance with information stored in memory associated with the microprocessor. Feedback information indicative of the position of the parts of the pump is provided by the transducers. The control system in addition receives information regarding the engine speed from a transducer 19 and also a signal indicative of driver demand from a transducer 20. Other transducers may be provided to supply other signals representing other variables such as air temperature and pressure and in addition, a transducer 21 which provides signals representing the angular position of the drive shaft 11 and hence the rotary parts of the pump relative to the body of the pump.

As shown the pump test record is indicated at 22 and is secured to the body of the pump. The test record is conveniently in the form of a solid state read only memory. It may also comprise a semi-conductor read only memory or it could comprise a network of discrete electrical components such for example as resistors capacitors and inductors whose values are set to represent the desired information. The test record is permanently connected to the control system 13 by means of conductors in the cable 14 and the stored information is utilised during the operation of the apparatus. Alternatively it may be connected to the control system by a special cable only when assembly is completed and the test data it contains stored in a test data memory in the control circuit, whereafter the special cable can be removed.

A further alternative would be to provide a socket 23 in the control circuit into which the test record 24 could be inserted for use in either of the ways outlined above. In this case the memory and the pump would be provided with corresponding markings to identify the memory with the particular pump and/or some means of ensuring that if the pump were disconnected from the control circuit the memory would also have to be withdrawn from the socket. In the case where the information in the memory is transferred to another memory in the control system and where the memory is attached to the pump, it would be necessary to ensure that the memory in the control system is up-dated in the event that the pump is changed.

The memory will contain information regarding the amount of fuel pumped for different settings of the distributor member. Since the pump output will tend to vary with speed, the tests could be carried out at a number of different speeds. In addition, the memory will contain information regarding the timing of delivery of fuel this being related to the angular position of the shaft 11 and the position of the cam ring.

It will be understood that the invention may be applied to other types of pumping apparatus incorporating an electrically operated control which varies a pump operating parameter. The invention is also applicable to pumping apparatus for supplying fuel to a spark ignition engine.

We claim:

1. A fuel supply system for supplying fuel to an internal combustion engine, in particular a compression ignition engine, comprising a mechanically actuated high pressure pump, at least one electrically operated control for determining an operating parameter of the pump, an electronic control system for controlling the flow of electric current to said control, thereby to influence said operating parameter, a test record associated with the pump, said test record containing test data of that particular pump which is utilized to supply test data to the control system, said control system being arranged to utilize said test data of said pump in determining the exact operating parameter associated with the exact pump being used whereby test data for an individual pump is made available for use by said control system so that an exact amount of fuel can be supplied to the engine at a precise timing of delivery.

2. A system according to claim 1 in which said test record comprises a solid state memory.

3. A system according to claim 1 in which said test record comprises a network of discrete electrical components.

4. A system according to claim 1 in which said test record is secured to the body of said pump.

5. A system according to claim 1 in which said test record is permanently connected to the control system by a cable.

6. A system according to claim 1 in which said electronic control system includes a socket to receive said test record.

7. A fuel supply system for supplying fuel to an internal combustion engine, in particular a compression ignition engine, comprising a mechanically actuated high pressure pump, at least one electrically operated control for determining an operating parameter of the pump, an electronic control system for controlling the flow of electric current to said control, thereby to influence said operating parameter, a test record associated with the pump which is utilized in use to supply test data to the control system, said control system being arranged to utilize said data, in determining said operating parameter of the pump in use, and said control system including a test data memory, the test data in said test record being transferred to said test data memory using a special cable removable when the transfer of the data has taken place.

* * * * *